United States Patent [19]

Adelsperger

[11] 4,231,792

[45] Nov. 4, 1980

[54] CHUTE WITH HAZARDOUS FLAME AND FUME CONTROL

[75] Inventor: Frederic J. Adelsperger, Highland, Ind.

[73] Assignee: Republic Steel Corporation, Cleveland, Ohio

[21] Appl. No.: 23,336

[22] Filed: Mar. 23, 1979

[51] Int. Cl.[3] ..... C21C 7/00; C21B 7/16

[52] U.S. Cl. ..... 75/53; 75/129; 266/216; 266/217; 266/265

[58] Field of Search ..... 75/53, 129; 266/216, 266/217, 265

[56] References Cited

U.S. PATENT DOCUMENTS

| | | | |
|---|---|---|---|
| 3,206,299 | 9/1965 | Senior | 75/11 |
| 3,761,248 | 9/1973 | Avery | 75/67 R |
| 3,836,360 | 9/1974 | Bray | 266/216 |

*Primary Examiner*—P. D. Rosenberg

*Attorney, Agent, or Firm*—Watts, Hoffmann, Fisher & Heinke Co.

[57] ABSTRACT

Air injectors are located in a ladle additive chute to eliminate the chimney effect created by the chute and hot gases present when a furnace is tapped. Air is supplied through openings about the chute below an open upper end, through which ladle additives are charged. The openings direct the air downward and inward of the chute and the air is supplied at a pressure and flow sufficient to prevent smoke, fumes and eruptive flames from rising through the chute when alloys are added to the metal being poured into the ladle.

8 Claims, 5 Drawing Figures

CHUTE WITH HAZARDOUS FLAME AND FUME CONTROL

BACKGROUND OF THE INVENTION

1. Field of The Invention: This invention relates to methods and apparatus for preventing a chimney effect through a ladle additive chute when materials are introduced to molten metal.

2. Prior Art: In the making of steel, additives such as alloying materials and the like are best introduced while molten steel is tapped from a furnace into a ladle. For example, in basic oxygen process furnaces, additives such as sulfur, coke, ferromanganese, and others are introduced from above the furnace and ladle through a chute that opens at its lower end above the ladle adjacent the molten stream of metal that flows from the furnace into the ladle. Not only do the ambient gases heated by the steel rise through the chute at that time, but also the additives themselves may create smoke, fumes or eruptive flames, as with sulfur, that rise through the chute. At times, flames may extend 10 to 12 feet above the chute. Where ladle additions are made manually, this creates a substantial hazard to a workman; when made automatically, certain parts of the equipment adjacent the chute inlet, such as load cells for weighing the additives, may be damaged by the heat. In effect, this condition has made it difficult or impossible to make ladle additions at the proper time during tap without taking some measures to retard the back draft.

Attempts to vary the addition technique, as by placing the additive in the empty ladle and then tapping the furnace have resulted in a poor mix and segregation of alloying materials in the heat. Mechanical swinging gates or dampers have been used in chutes to close off back drafts, but have the disadvantage of being subject to failure due to their mechanical nature and the unfavorable environment, and may block the chute at a critical time. Separate evacuation systems to divert the back drafts have also been attached to chutes, but have been expensive.

In a different environment, charging systems for furnaces have been shown that create a static gas seal at a charging opening using scrubbed gas from the furnace to prevent dirty gas from within the furnace from escaping. See U.S. Pat. No. 3,198,623. Such gas from the furnace is combustible and the arrangement is neither structurally nor functionally satisfactory for a ladle additive chute. In particular, combustible gas would ignite and a static seal is not practical or sufficiently effective for present purposes.

SUMMARY OF THE INVENTION

The present invention relates to an improved ladle addition chute and method for preventing a chimney effect that results in upward flow of hot gases and eruptive flames through the chute to a charging floor, where ladle additives are fed into the chute while a furnace is tapped into a ladle below the floor. In accordance with this invention, the chimney effect is prevented by creating a dynamic air seal between an upper entry opening of the chute at the charging floor and a lower discharge opening adjacent the ladle into which molten metal is tapped and ladle additives are made. Specifically, gas under pressure is introduced about a cylindrical portion of the chute, just beneath an upper hopper portion that receives the ladle additions. The gas is introduced about the periphery of the chute and is directed both downward and centrally of the chute, at a location substantially in a plane across the chute. Structure about chute assures proper direction of the flow of gas. In a preferred construction gas is introduced through peripherally spaced passageways about the chute wall that direct the flow in the desired direction. The number and characteristics of the passageways are such that with sufficient gas flow and pressure, the flow not only counteracts upward currents due to the chimney effect of the chute, but also moves positively in a downward direction through the chute, creating a lower than ambient pressure in the chute above the location at which the gas is introduced. Thus, the pressurized gas introduced about the periphery of the chute prevents the chimney effect and also draws dust and fumes from above the chute down through the chute to the level below, improving the environment and reducing the heat at the charging floor. The environment is thereby made safer both for workers in the case where ladle additives are introduced manually, and for automatic equipment where the charge is automatically weighed and introduced.

In a preferred embodiment, the passageways for gas are openings in the chute wall and tubular conduits secured to the outside of the chute around each aperture. The tubular conduits each extend from the chute surface outward and upward so flow through the conduits into the chute will be directed toward the central axis of the chute and downward. Air under pressure is supplied to the conduits through a manifold from a single source, so a substantially equal flow and pressure are established through each conduit. By directing the tubular conduits slightly to one side of the central axis of the chute, a swirling action or vortex can be established that aids in creating a vacuum above the entrance of the air for drawing fumes and dust downward through the chute.

The present arrangement allows the free passage of alloy additions and the like through the chute while at the same time assuring that dust, particles and fumes are drawn down through the chute rather than being allowed to swirl upward by a chimney effect. The present arrangement prevents eruptive flames that occur from additions that are made while a furnace is tapped into a ladle and prevents hot gases in the ladle area from reaching the charging floor through the chute. All need for mechanical seals or doors in the chute to prevent draft is eliminated, avoiding any risk of possible blockage during operation. Moreover, the gas introduced through the opening will not ignite or burn the alloying additions prematurely. The chute finds particular use in connection with equipment for the making of steel in basic oxygen process furnaces, such as conventional BOF installations or the newer bottom blown basic oxygen process furnaces, where it is customary to make alloying additions to a ladle into which steel is poured from the furnace during tapping.

The above and other features and advantages of this invention will become better understood from the detailed and description that follows, when considered in connection with the accompanying drawings.

DETAILED DESCRIPTION OF A PREFERRED EMBODIMENT

Figure 1:
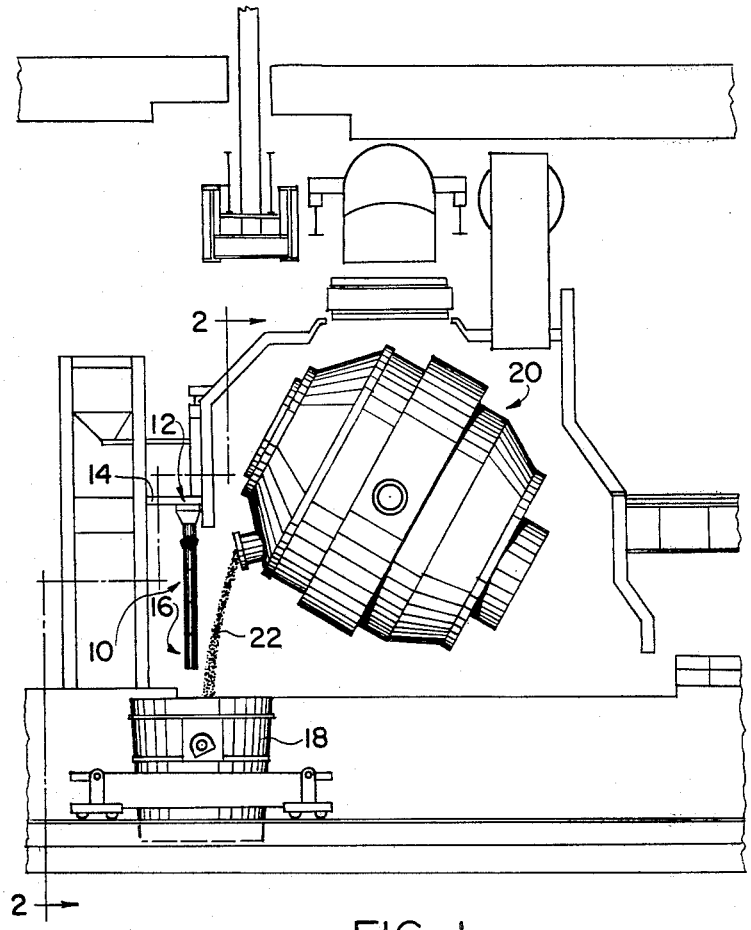
FIG. 1 is a diagrammatic side elevational view, with parts in section and in part broken away, illustrating a bottom blown basic oxygen process furnace, a ladle into which the furnace is tapped, and illustrating a chute embodying the present invention for making alloying additions to the ladle.
Figure 2:
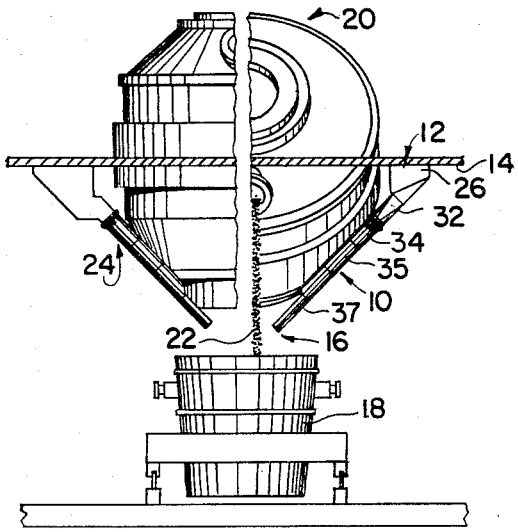
FIG. 2 is a front elevational view of the basic oxygen process furnace, ladle, and ladle addition chutes, as viewed approximately from the plane indicated by the line 2—2 in FIG. 1, with parts removed, and looking in the direction of the arrows, the furnace being partially shown in each of two positions for illustration purposes.

A chute 10 embodying the present invention is illustrated in FIGS. 1 and 2 in a typical surrounding environment. The chute 10 has an open upper end 12 supported at a charging floor 14, and has an open lower end 16 above a teeming ladle 18. The chute is adjacent the front of a furnace 20 and is substantially straight, but inclined. At its upper end at the charging floor 14, it is located to one side of the furnace. At its lower end it is located centrally of the furnace, approximately aligned with the path of the metal stream, indicated at 22, that flows from the furnace when the furnace is tapped. Alloy additions introduced through the chute to the ladle will mix in the metal stream 22 and with the metal in the ladle as both the additions and the stream enter the ladle.

A second chute 24 is shown in FIG. 2, constructed substantially the same as the chute 10, and angled in the opposite direction from a location at the charging floor 14, from a position on the opposite side of the furnace from the chute 10 to a location centrally of the furnace, approximately aligned with the path of the metal stream 22. For an understanding of the present invention, only the chute 10 need be described in detail.

It will be apparent from the relationship of the chutes 10 and 24 with respect to the teeming ladle 18 that, when the furnace 20 is tapped and molten metal poured into the ladle by rotating the furnace, as illustrated in FIG. 1 and in the right hand portion of FIG. 2, the molten stream of metal will be directly adjacent the lower ends of the chutes. Ambient air and other gases at the ladle, heated by the molten metal and discharged by the furnace, will tend to rise through the chute by virtue of the chimney effect created by the temperature differential of the atmosphere the upper and lower at ends of the chute. Also, certain ladle additions, such as sulfur, erupt into flames when contacted by the hot metal and if the chimney effect is not inhibited, the flames will be carried upward through the chute to the charging floor, where workers or automatic hoppers (not shown) are endangered by the heat and flames.

Figure 3:
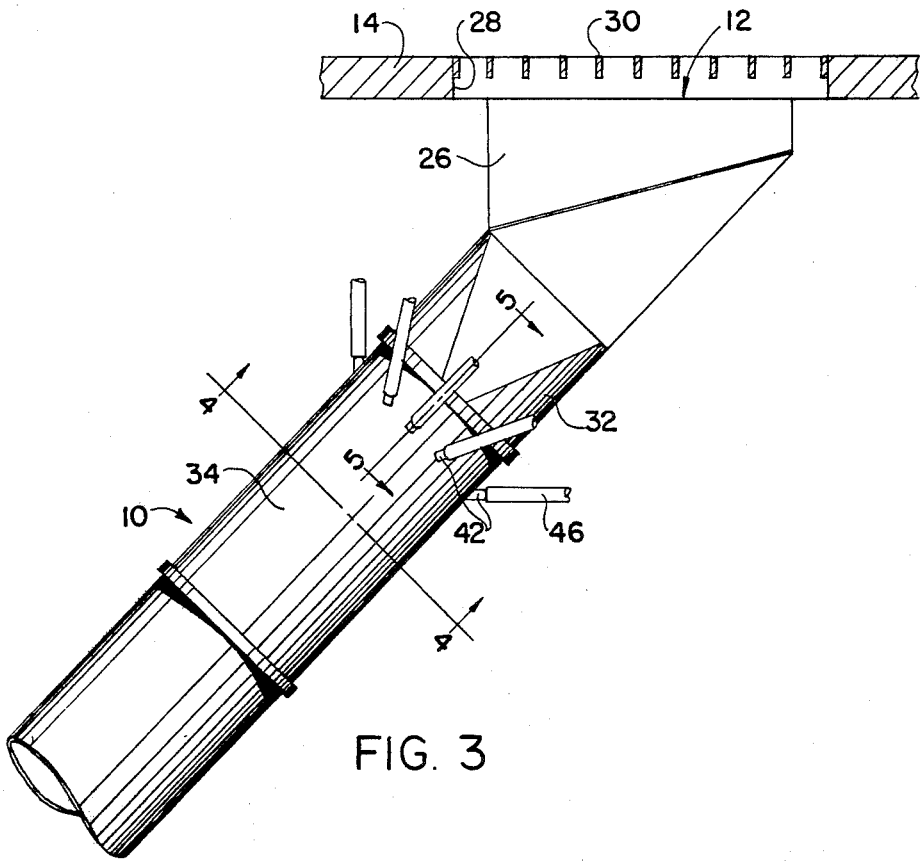
FIG. 3 is an enlarged partial view of one of the ladle addition chutes shown in FIG. 2, illustrating tubular conduits for introducing gas under pressure into the chute.
Figure 4:
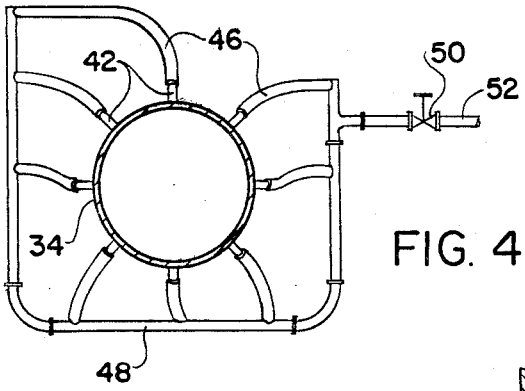
FIG. 4 is a diagrammatic view partly in section and partly in elevation of the chute of FIG. 3 taken along the plane indicated by the line 4—4 of FIG. 3 and looking in the direction of the arrows.

The construction of the chute 10 is best shown in FIG. 3. The upper portion of the chute is in the form of a hopper 26 open at its upper level, which is essentially flush with the charging floor 14. An opening 28 in the charging floor, is covered with a grate 30, through which ladle additions can be charged. The hopper portion 26 tapers to a transition portion 32, which joins an upper cylindrical section 34. Three successive additional sections 35, 36, and 37 complete the chute, as shown in FIG. 2. In the preferred embodiment, the chute sections are made of steel pipe, 24 inches in outside diameter and having a wall thickness of 1 inch, except for the bottom section which may be through-shaped.

Figure 5:
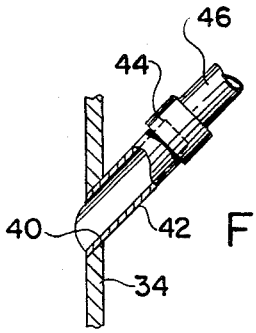
FIG. 5 is a sectional detailed view of a conduit for introducing gas under pressure into the chute, taken along the line 5—5 of FIG. 3 and looking in the direction of the arrows.

Just beneath the transition portion 32, in the cylindrical section 34, a plurality of openings or passages 40, one of which is shown in detail in FIG. 5, are equally spaced about the periphery of the chute in a common transverse plane. In the preferred embodiment, eight openings or passages are provided, with their centers located in a plane perpendicular to the longitudinal axis of the chute. Eight short tubular conduits 42, cylindrical in the preferred embodiment, extend outwardly from the chute section 34, one at each opening 40. The conduits 42 are each connected by a coupling 44 to a separate supply hose 46 connected to a common manifold 48. A hand-operated flow control valve 50 in a supply line 52 to the common manifold controls the flow of air under pressure to the conduits 42.

As shown in FIGS. 3 and 5, each tubular conduit 42 is angularly related to the longitudinal extent of the chute to direct a flow of gas from the respective hose 46 in a downward and inward direction of the chute. In the preferred embodiment shown, the tubular conduits 42 are each oriented at a 45 degree angle with respect to the central longitudinal axis of the chute and are directed along radial planes toward the central longitudinal axis. While a 45 degree angle has been found to be particularly efficient, the tubular conduits 42 can be arranged at an angle of between 30° and 60° with the central longitudinal axis of the chute and will function adequately. If a vortex or swirling action is desired of the flow from the tubular conduits, to enhance the drawing of gases, dust and fumes into the upper open end of the chute, each tubular conduit can be oriented out of a radial plane, at a slight angle to one side of the central axis.

In a typical situation, where the chute 10 is used in connection with a basic oxygen furnace or a bottom blown basic oxygen process furnace, an air flow of 15 to 25 cubic feet per minute at the pressure of 40 to 80 pounds per square inch gauge, supplied through a two inch supply manifold 48, works well to establish a downward flow of air and other gases sufficient to overcome the tendency of hot gases to rise through the chute. Because such a supply volume is greater than the output carried through the conduits 42 and openings 40, by virtue of their size, the flow introduced through the openings to the chute is of constant volume and is uniformly distributed about the periphery. In the preferred embodiment, the tubular conduits 42 have an inside diameter of ½ inch. By virtue of the evenly distributed flow that results from this arrangement, an effective, generally uniform, downward movement of gas through the chute is created. An adequate minimum level of flow and pressure is important to establish an effective barrier against upward draft and to draw dust and fumes that might surround the entrance of the chute downward. Beyond such a minimum flow and pressure, enhanced results may be obtained, but at a greater cost. An effective flow at a satisfactory pressure can be readily determined empirically. The gas used is preferably air under pressure, because of its ready availability, low cost, and because it is a noncombustible. Use of a combustible gas is unsatisfactory, even though directed downwardly, because of its tendency to ignite certain alloy additives or packages in which the additives may be contained when introduced.

In a typical operation, an operator will control the flow of air through the tubular conduits 42 and openings 40 into the chute 10 with the valve 50, supplying air only slightly in advance of the time at which the furnace is tapped and at which time the adverse chimney effect will be created. While the gas is being introduced under adequate flow and pressure, alloy additives are deposited through the open upper end 12 of the chute concurrently with the pouring of molten metal from the furnace into the teeming ladle 18. The alloy additions move, unobstructed, through the flow of gas and any associated dust or the like is drawn down into the chute by the reduced ambient pressure above the location where the gas is introduced. Flames that may erupt upon entry of the additives into the stream of molten metal, or other fumes and the like associated with the hot environment surrounding the pouring area, are prevented from rising through the chute 10 to the charging floor 14. As a result, the temperature and quality of the air at the charging floor are greatly improved, resulting in a safer and more comfortable environment for workers and a lower temperature environment for automatic equipment that may be used for supplying ladle additions.

While a preferred embodiment of the invention has been described in detail, various modifications or alterations may be made therein without departing from the spirit and scope of the invention set forth in the appended claims.

What is claimed is:

1. In apparatus for making additions to molten metal, said apparatus including a tubular chute having an upper entry opening for receiving additions and a lower discharge opening adapted to be located adjacent an open vessel into which the molten metal is poured, said chute having a tendency to act as a chimney for hot gases, the improvement comprising means to inject gas into the chute between the upper entry opening and the lower discharge opening in directions toward the discharge opening and across the chute, at a flow rate and pressure sufficient to prevent an upward flow of hot gases through the chute when molten metal is poured into a vessel adjacent the lower discharge opening, and to create a lower than ambient pressure at the upper entry opening.

2. Apparatus as set forth in claim 1 wherein the means to inject gas includes a plurality of openings and directional passageways spaced peripherally about the chute.

3. Apparatus as set forth in claim 2 wherein said openings are equally spaced peripherally, are located in substantially a common plane across the chute and wherein said improvement further includes means for supplying gas at substantially equal pressures and flow rates to the openings.

4. Apparatus as set forth in any of claims 1, 2 or 3 wherein the chute has a central longitudinal axis and the angle at which the gas is injected is between 30° and 60° from a transverse plane perpendicular to the central longitudinal axis in a direction toward the discharge opening and in a direction substantially non-tangential to the chute periphery.

5. An apparatus for making alloy additions to molten metal in a vessel, said apparatus including a tubular chute having an upper entry opening for receiving alloy additions and a lower discharge opening adapted to be located adjacent the vessel, said chute having a tendency to act as a chimney for hot gases when molten metal is in a vessel adjacent the lower discharge opening, the improvement comprising a plurality of directional inlet openings into the chute equally spaced peripherally and located beneath the upper entry opening, oriented to direct a flow of gas into the chute each at the same angle between 30° and 60° from a transverse plane perpendicular to a central longitudinal axis of the chute in a direction toward the discharge opening and non tangential to the chute periphery, and a manifold for connecting said inlet openings to a source of gas under pressure, said manifold having a capacity to carry a greater flow than that of the combined inlet openings to assure substantially uniform pressure and flow at the inlet openings.

6. Apparatus as set forth in claim 5 wherein a hopper forms the upper entry opening, said hopper being of larger cross-sectional dimensions than the remainder of the chute, and said inlet openings are located directly beneath the hopper.

7. In a method of making additions to molten metal, including the steps of pouring molten metal into a vessel, introducing additions into the metal during pouring by dropping the additions through a tubular chute extending from a level substantially above the vessel to a level adjacent and above an opening to the vessel, said chute having open upper and lower ends and tending to act as a chimney up which hot gases flow from the vessel, the improvement comprising introducing gas into the chute, concurrently with the additions, between the open ends at locations peripherally of the chute, at sufficient pressure and in sufficient quantity to create a downward flow of gas through the chute that prevents upward flow of hot gases and that reduces the pressure at the open upper end of the chute to below ambient pressure.

8. The method as set forth in claim 7 wherein the gas is introduced in a downward and inward direction at locations equally spaced peripherally about the chute.

* * * * *

UNITED STATES PATENT AND TRADEMARK OFFICE

CERTIFICATE OF CORRECTION

PATENT NO. : 4,231,792

DATED : November 4, 1980

INVENTOR(S) : Frederic J. Adelsperger

It is certified that error appears in the above-identified patent and that said Letters Patent are hereby corrected as shown below:

Column 6, delete claim 6;

line 37, change "7" to -- 6 --;

line 53, change "8" to -- 7 --;

line 53, change "7" to -- 6 --.

On the Title Page after the Abstract, "8 Claims" should read -- 7 Claims --.

Signed and Sealed this

*Seventeenth* Day of *February 1981*

[SEAL]

*Attest:*

RENE D. TEGTMEYER

*Attesting Officer*

*Acting Commissioner of Patents and Trademarks*